United States Patent [19]

Fleury et al.

[11] Patent Number: 4,825,912

[45] Date of Patent: May 2, 1989

[54] APPARATUS FOR WEAVING SPHERIODIALLY CONTOURED FABRIC

[75] Inventors: Gilles A. Fleury, Garden Grove; Robert L. Lavallee, Perris, both of Calif.; Thomas S. Ohnstad, Marysville, Wash.

[73] Assignee: Ciba-Geigy Corporation, Ardsley, N.Y.

[21] Appl. No.: 77,672

[22] Filed: Jul. 23, 1987

[51] Int. Cl.[4] ..... D03D 49/20

[52] U.S. Cl. ..... 139/305

[58] Field of Search ..... 139/11, 35, 97, 188 R, 139/304, 305

[56] References Cited

U.S. PATENT DOCUMENTS

| | | | |
|---|---|---|---|
| 626,314 | 6/1899 | Wever et al. | 139/305 |
| 1,421,081 | 6/1922 | Hall | 139/305 |
| 1,503,871 | 8/1924 | Bartholomew | 139/305 |

FOREIGN PATENT DOCUMENTS

| | | |
|---|---|---|
| 474176 | 3/1929 | Fed. Rep. of Germany . |
| 1069282 | 2/1954 | France . |
| 1061164 | 11/1954 | France . |
| 1223545 | 2/1960 | France . |
| 2490687 | 3/1982 | France . |

*Primary Examiner*—Henry S. Jaudon
*Attorney, Agent, or Firm*—Harry Falber

[57] ABSTRACT

A loom for weaving contoured cloth has a shed forming part for forming a warp yarn shed, a rapier apparatus for inserting successive lengths of weft yarn through the shed, a beating up apparatus for beating up the weft yarns into a woven fabric, a contoured rotatably driven mandrell positioned downstream, relative to the direction of the warp yarn movement, for receiving the woven fabric and drawing it from the beating up apparatus, the mandrel having at least a part thereof with a spheroidal shape for giving a spheroidal shape to the fabric passed around the mandrel, nip rollers pressing the woven fabric against the mandrel for causing said mandrel to draw the woven fabric from the beating up apparatus and shape the fabric according to the contour of the mandrel, a fabric guide having a contour along the mandrel corresponding to the contour of said mandrel and guiding the fabric into engagement with the mandrel, and warp yarn path length extenders positioned along the path of the fabric from the beating up apparatus to the fabric guide for increasing the lengths of the paths of the warp yarns of the fabric which are directed onto the portions of the spheroidally contoured part of the mandrel which are larger than the smallest diameter portion of the spheroidally contoured part, sufficient for causing substantially all the length of each of the respective weft yarns to reach the mandrel at the same time.

9 Claims, 4 Drawing Sheets

FIG. 7a.
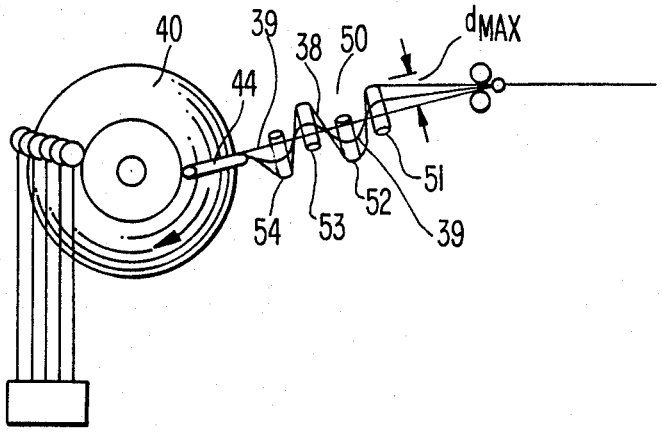
FIG. 7b.
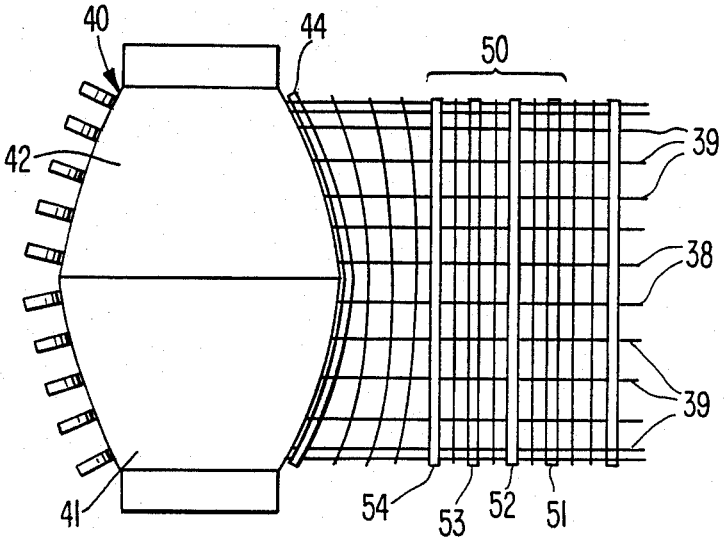
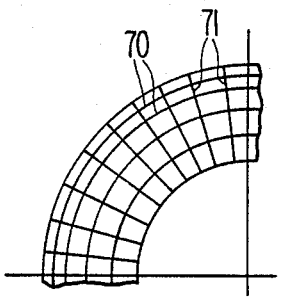
FIG. 8.

APPARATUS FOR WEAVING SPHERIODIALLY CONTOURED FABRIC

This invention relates to an apparatus for producing a spheroidally contoured fabric from a yarn which is somewhat difficult to weave.

BACKGROUND OF THE INVENTION

The production of a spheroidally, or more particularly a spherically, contoured fabric of material which is difficult to weave, such as a carbon fiber material, has become desirable in recent times for use in the formation of shims for spherically shaped rocket nozzle parts, for use in the construction of parabolic antennae, and as bases or cores for radar domes made of resin or the like.

Ordinary yarn or thread, such as that made from cotton or wool or similar artificial yarns, can be formed into spheroidally contoured fabrics on conventional shuttle-type looms. However, these looms are not very well adapted for yarns or threads with different characteristics, such as low or medium modulus of elasticity carbon yarns, E-glass or S2-glass yarns, or other aerospace grade or egineered type yarns, which are more difficult to weave. These will hereinafter be referred to simply as "more difficult to weave" yarns. When these more difficult to weave yarns are run on a conventional shuttle loom, it is difficult to handle and does not produce sufficiently satisfactory fabric for the purpose of forming shims and the like. This is because when the warp yarns are formed into the shed and moved vertically past each other as the shed is changed during normal weaving to the degree this is done in the conventional shuttle-type loom, the yarns tend to fray or even break. Further, because the ordinary reciprocating shuttle carries a supply of weft or filler yarn thereon, it is difficult to satisfactorily operate the shuttle because the yarn is difficult to wind into the relatively small space on the shuttle, and it is bent extensively as it is unwound and passed through the shed of the warp yarns during the reciprocal motion of the shuttle. This also leads to fraying of the yarn and breakage to an extent which is not acceptable for normal production requirements.

A rapier-type loom, also variously called a needle type loom or a shuttleless loom, has been used for the weaving of contoured fabrics of another difficult to weave yarn, namely aramid, a thread or yarn sold under the trade name Kevlar by E.I. Dupont De Nemours & Co. Such a loom is also adaptable to weave the above-described difficult to weave yarns, because the rapier or needle is relatively small in cross section as compared with a conventional shuttle, moving through the shed to pick up a single length of filler or weft thread and then drawing it back through the shed, it is not necessary to move the warp yarns to the same extent during changing of the shed as in a conventional shuttle loom, thereby reducing the opportunity for fraying. Moreover, because the rapier simply picks up the end of a length of filler or weft yarn, and simply draws it across the shed during the return movement of the rapier, there is essentially no bending of the weft thread and thus little or no opportunity for breakage.

The rapier-type loom is therefore a desirable type loom for weaving of the highly heat insulating fiber material or fibers with similar characteristics.

However, the amount of contouring of the woven fabric which can be achieved by the usual rapier-type loom is relatively limited. The contouring is achieved by providing the desired contour on the peripheral surface of the mandrel which takes up the fabric after it has been woven at the shed area and which feeds the contoured fabric to a take-up roller on which the finished fabric is stored. The degree of contouring of the mandrel, however, must be limited. The reason for this is that at larger diameter portions of the mandrel, for example near the longitudinal middle of the mandrel, the warp yarns or threads coming from the shed area of the loom will be drawn in the direction of the mandrel along a shorter path and at a higher speed than warp yarns which extend around the smaller diameter portions of the mandrel, for example at the ends of the mandrel. This tends to cause the parts of the weft yarns or threads which are toward the edges of the fabric to lay behind the part in the center of the fabric so as to be changed from their normal direction perpendicular to the length of the warp yarns or threads to distorted positions in which they are at an angle to the warp yarns or threads. The greater the difference in diameter between the larger diameter portions and the smaller diameter portions of the mandrel, the more that the portions of the weft yarns or threads toward the edges will be caused to lag, and the greater will be the distortion of the position of the weft yarns or threads from the perpendicular position. When the distortion of the position of the weft yarns or threads becomes too great, the fabric becomes unsatisfactory.

This problem is accentuated when it is attempted to provide a profile for the mandrel which will produce a spheroidally shaped cloth, specifically a spherically shaped cloth, since the differences between the larger diameter portions and the smaller diameter portions become rather large. In the finished product, while the warp yarns or threads will be substantially circumferential around the axis of a sphere, in the nature of the latitude lines on a globe, the weft yarns or threads will not run in planes parallel to the axis of the sphere, in the nature of longitude lines on a globe, but rather will be caused to curve away from such positions from the larger diameter edge of the spherical portion to the smaller diameter edge. This problem will be discussed more fully hereinafter. This distortion of the position of the weft yarns or threads makes the fabric unsatisfactory.

Another property of spheroidally contoured fabric is that if it is shaped from fabric in which the weft yarns and warp yarns are uniformly spaced across the fabric, when the fabric is shaped into a spherical shape, the weft yarns will be closer together at the portion of the fabric nearer the pole of the sphere, i.e. the fibers lying along longitude lines of the sphere will converge toward the poles, so that the density of the fabric will increase toward the poles of the spheroid. This can be undesirable.

OBJECTS AND BRIEF SUMMARY OF THE INVENTION

It is an object of the present invention to provide a loom apparatus for making spheroidally contoured fabric from a yarn which is somewhat stiff, such as a highly heat insulating material, which apparatus avoids the disadvantages of the prior art loom apparatus.

It is a further object of the present invention to provide a modified rapier-type loom suitable for making spheroidally contoured fabric from a yarn which is somewhat stiff, such as a highly heat insulating material.

It is a further object of the invention to provide a loom apparatus for making spheroidally contoured fabric in which the density of yarns in the fabric is substantially constant throughout the area of the fabric.

These objects are achieved according to the present invention by a loom for weaving contoured cloth, comprising:

shed forming means for receiving warp yarns from a warp yarn supply and forming a warp fiber shed;

means for inserting successive lengths of weft yarn through the shed formed by said shed forming means;

means for beating up the weft yarns into a woven fabric;

a contoured rotatably driven mandrel positioned downstream, relative to the direction of the warp yarn movement, from said beating up means for receiving the woven fabric and drawing it from said beating up means, said mandrel having at least a part thereof with a spheroidal shape for giving a spheroidal shape to the fabric passed around the mandrel;

a nip roller means engaged with the contoured surface of said mandrel for pressing the woven fabric against said mandrel for causing said mandrel to draw the woven fabric from said beating up means and shape the fabric according to the contour of said mandrel;

a fabric guide means adjacent said mandrel at a position along the path of the fabric from said beating up means to the point on said mandrel where said nip roller means is positioned, said fabric guide means having a contour along said mandrel corresponding to the contour of said mandrel and guiding the fabric into engagement with said mandrel; and warp yarn path length extending means positioned along the path of the fabric from said beating up means to said fabric guide means and having a contour transversely of the path of the fabric for increasing the lengths of the paths of the warp yarns of the fabric which are directed onto the portions of the spheroidally contoured part of said mandrel which are larger than the smallest diameter portion of the spheroidally contoured part, the increase being sufficient for making the lengths of such paths sufficiently longer than the length of the path of the warp yarn which is directed onto said smallest diameter portion of the spheroidally contoured portion of said mandrel to cause substantially all the length of each of the respective weft yarns to reach said mandrel at the same time.

It is to be understood that the present invention is for use in producing spheroidal shaped fabrics. However, for simplicity of explanation, the description of the invention is directed only to spherically shaped fabric. It is not intended that the invention be so limited, however.

BRIEF DESCRIPTION OF THE FIGURES

Other and further objects of the invention will become apparent from the following description, taken in conjunction with the accompanying drawings, in which:

FIG. 7*a* is a schematic end elevation view similar to FIG. 5 showing the improved mandrel and associated structure for a rapier-type loom according to the present invention;

FIG. 7*b* is a plan view of the strucgture of FIG. 7*a;* and

FIG. 8 is a schematic plan view of a part of an annular member formed from the spherically contoured fabric made on the apparatus according to the present invention.

DETAILED DESCRIPTION OF THE INVENTION

Figure 1A:
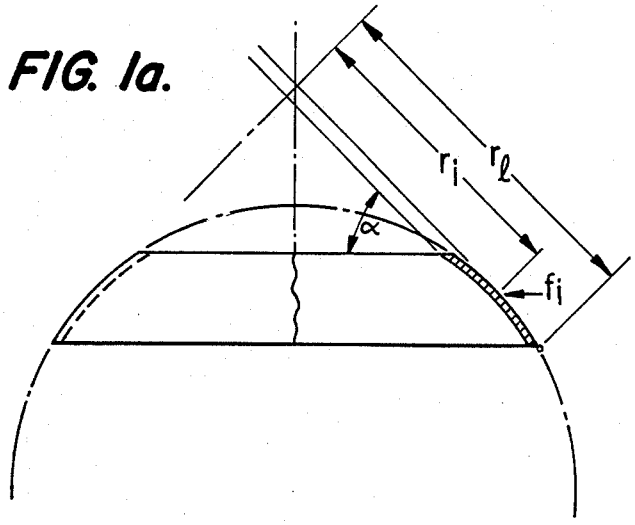
FIG. 1*a* is a side elevation view of an annular spherical shim made from spherically contoured fabric produced by the apparatus according to the present invention.
Figure 1B:
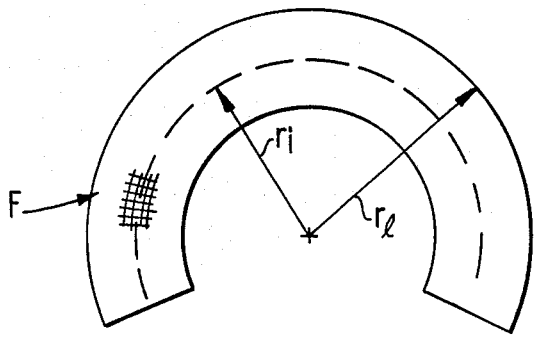
FIG. 1*b* is a plan view of a developed piece of fabric which can be formed into the shim of FIG. 1*a;*

One embodiment of the spherically contoured fabric product which it is desired to produce is shown in FIGS. 1*a* and 1*b*, and it consists of a spherically contoured piece of fabric preferably made of a difficult to weave yarn, such as low or medium modulus carbon yarn, which is to serve as an annular spherical shim for use in a rocket nozzle. The product, in its finished form as shown in FIG. 1*a*, is constituted by a section of a sphere, shown in broken lines, which is defined between two parallel planes which extend perpendicularly to the vertical axis of the sphere. As will be appreciated, the shim is designed to lie against the inside of a concave spherical part of the rocket nozzle to shim up a further part which fits into the spherical portion against which the shim rests. Thus, the configuration of the exterior of the shim is part of the surface of a sphere. As can be seen from the right-hand sectional portion, the cross section of the fabric will be circularly curved.

The product is made up from the developed shape as shown in FIG. 1*b*, and it will be appreciated that the cross section of the developed shape will be the same as that shown in the right-hand part of FIG. 1*a*, and when the shape lies convex side down on a surface, the shape will be slightly convexly curved upwardly.

It is this developed shape which is produced from the improved rapier-type loom according to the present invention.

As can be seen from the drawings, the outermost warp yarn f of the developed shape will be at a radius r from the center of the shape, and the intermediate warp yarns $f_i$ will be at radii $r_i$. The weft yarns will extend substantially radially across the warp yarns, as shown schematically at the portion F in FIG. 1*b*. The manner in which this particular shape of fabric is obtained from the loom will be described in greater detail hereinafter.

As pointed out above, the fabric is produced on an improved loom, which is variously known in the art as a shuttleless loom, a needle-type loom, or a rapier-type loom. A conventional loom of this type is shown somewhat schematically in FIGS. 2*a* and 2*b*, and generally consists of a frame 10 which carries the remainder of the loom parts. Warp yarns or threads 11 are supplied from a creel 12 which contains a number of spools 12*a* on which the individual warp yarns 11 are wound, and they are supplied past a guide bar means 13 to a conventional shedding mechanism, which includes the conventional harnesses 14 which carry the heddles 15 to which the individual warp yarns are fed in an alternating pattern according to the weave desired. The up and down movement of the harnesses 14 is provided by the harness driving means 16 shown schematically, in a conventional fashion. Within the shed is the lay 17 on which the needle guide 18 is provided, the lay being driven in a conventional manner by a lay driving means 19 in order to beat up the weft yarns which are carried across the shed by a needle. In the particular type of apparatus which has been in current use for the production of fabric from the Kevlar yarn, there is a pair of press rolls 20 at the downstream end of the shed where the weft yarns are beat up, and the thus woven fabric extends around a driven mandrel 21 over an idler roller 22 immediately above the mandrel 21, and is held against the mandrel by a nip roller 23 so as to be drawn off the loom by rotation of the mandrel. From the nip roller, the fabric is wound up on a fabric take-up roll 24.

The loom of course has all of the conventional mechanisms for its complete operation, all of which are conventional and well known to those skilled in the art. They do not form any part of the present invention and are accordingly not described.

The needle or rapier 25 is sufficiently long to extend entirely across the shed, and has a yarn gripping means 26 for gripping the weft yarn from a weft yarn supply 27 and drawing it across the shed on the return stroke of the needle. The individual weft yarns are then cut from the yarn supply by a cutting means (not shown). The needle 26 is guided back and forth in the raceway 28, being driven by a conventional needle driving means 29.

Figure 2A:
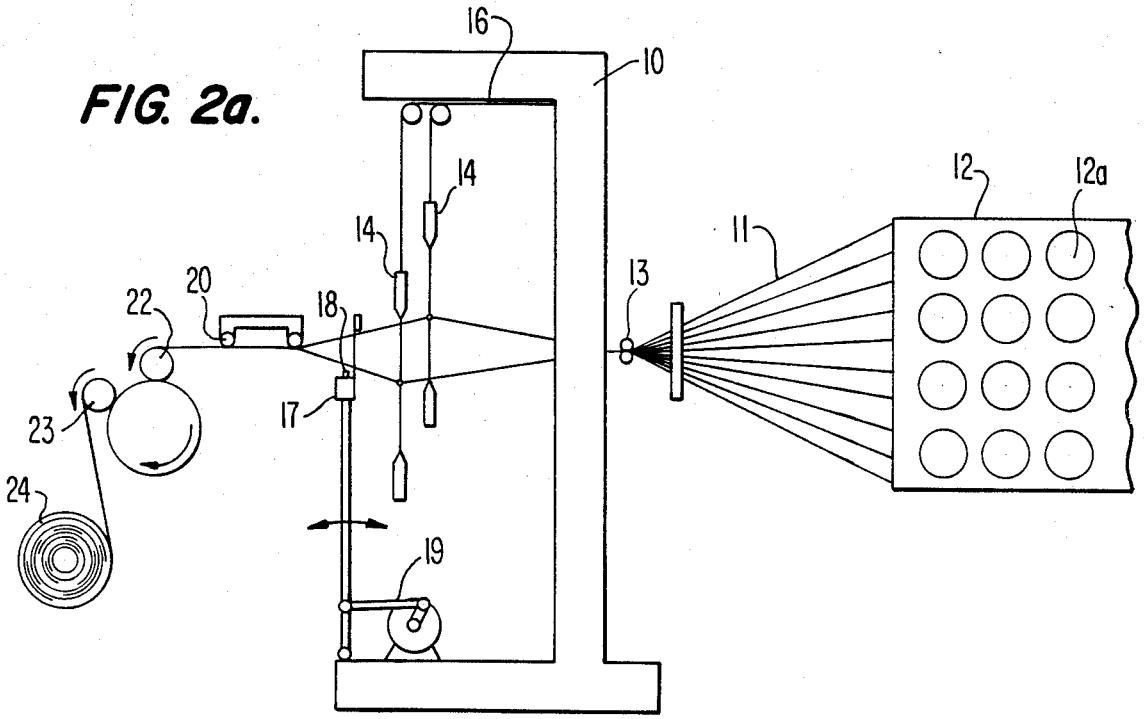
FIG. 2*a* is a diagrammatic side elevation view of a conventional rapier-type loom.
Figure 3:
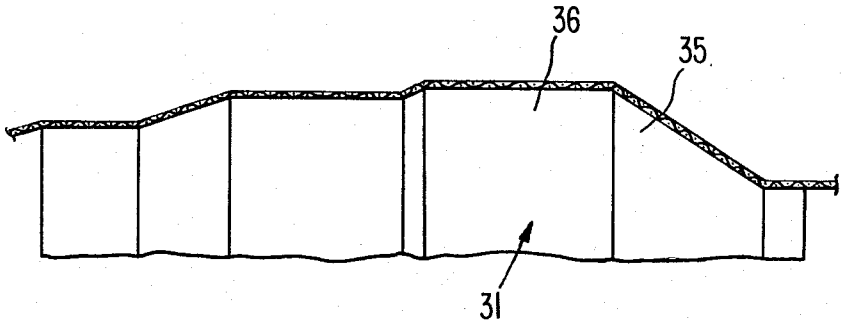
FIG. 3 is a schematic sectional view of a contoured mandrel of a type which has been used on the loom of FIGS. 2*a* and 2*b;*

Contoured fabric of Kevlar has been successfully produced on a loom of this type, one example of such a contoured fabric being shown in FIG. 3. The mandrel 31 corresponding to the mandrel 21 of FIG. 2*a* is provided with a contoured surface having cylindrical portions 36 of different diameters joined by conical-shaped portions 35. The profile, as shown in FIG. 3 corresponds to the profile of a machine which it is desired to wrap with the Kevlar fabric in order to prevent any parts of the machine which may come loose during high speed operation from being thrown through the casing of the machine and away from the machine.

Figure 2B:
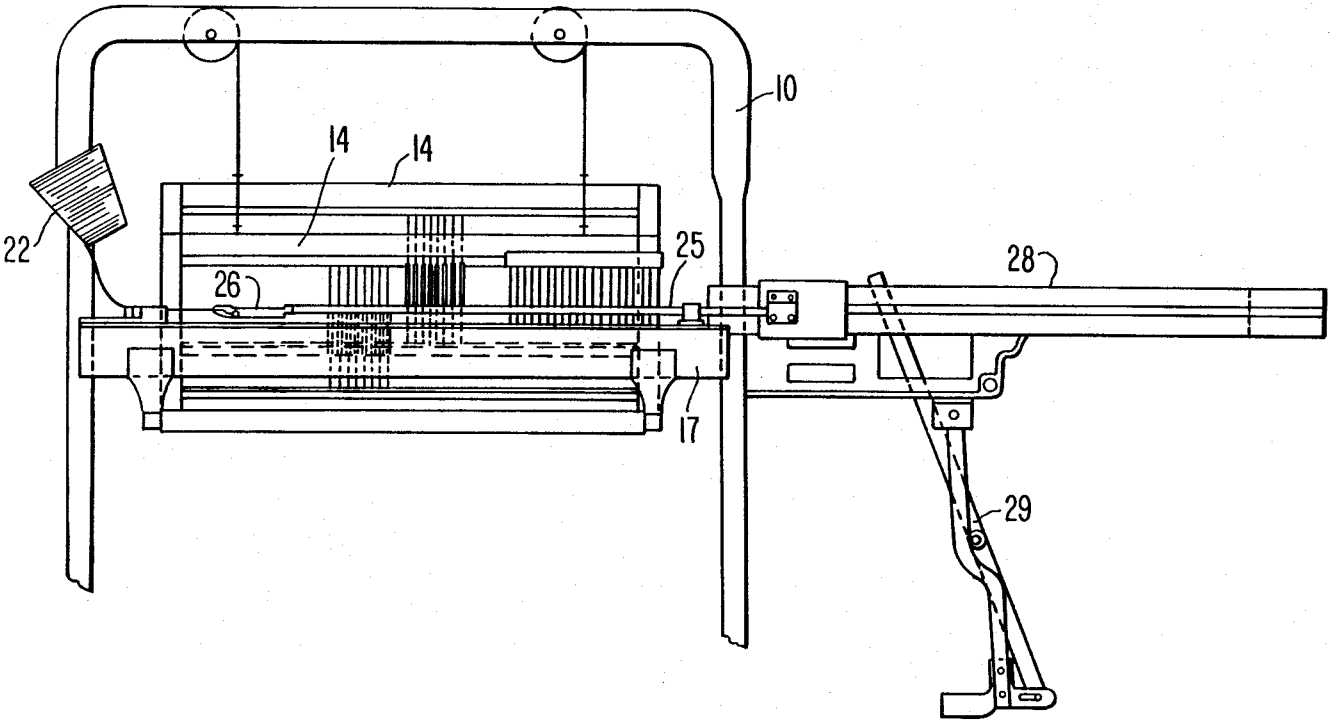
FIG. 2*b* is a front elevation view of the loom of FIG. 2*a;*

The fabric coming from the shedding mechanism of the loom of FIGS. 2*a* and 2b is drawn around the idler roll 22, and then drawn around the mandrel 31 of FIG. 3, at which point it is given the shape, in cross section, as shown in FIG. 3.

However, as can be seen from the contour shown in FIG. 3, while the conical transition portions 35 between most of the cylindrical portions 36 are relatively small and inclined only slightly to the cylindrical portions, at the right-hand end, there is a rather substantial size conical portion. It has been found in practice that at this portion of the fabric, the weft yarns tend to lag somewhat behind the portions of the weft which are carried by the warp yarns to the cylindrical portion 36 of the mandrel. This is because they must move a longer distance from the position at which the weft yarn is laid into the shed to the surface of the mandrel, as compared with the warp yarns which reach the cylindrical portion 36 of the mandrel immediately adjacent the large conical portion, and also because the warp yarns carrying these portions of the weft fibers to the conical portion of the mandrel are moving more slowly than the warp yarns moving to the cylindrical portion of the mandrel.

Figure 4A:
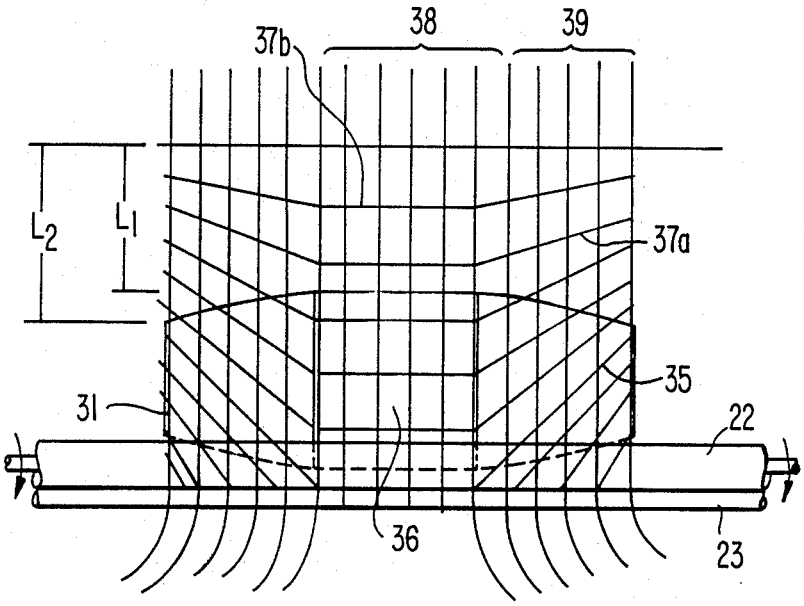
FIGS. 4*a* and 4*b* are respectively schematic plan and end views of a contoured mandrel with fabric being wound therearound on a conventional rapier-type loom.
Figure 4B:
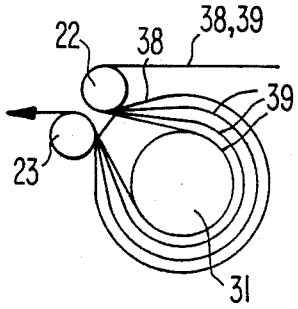

This condition is illustrated schematically in FIGS. 4*a* and 4*b*, which are respectively plan views and an end elevation view of a double ended conical mandrel with a cylindrical portion in the center thereof. It will first be seen that the warp yarns 39 will have to move through a longer path $L_2$ from the shed to the conical surface 35 of the mandrel than will the warp yarns 28 moving a distance $L_1$ to the cylindrical portion 36 of the mandrel. it will be further understood that the warp yarns generally indicated at 38 will proceed in the direction of the movement of the fabric from the point at which the weft yarn is inserted into the shed to the cylindrical portion of the mandrel at a speed $v_1$ corresponding to the circumferential speed of the surface of the cylindrical portion 36 of the mandrel, whereas the warp yarns 39 will proceed at a somewhat slower speed $v_2$, which progressively decreases the further outwardly from the cylindrical surface 36 the respective warp yarns 39 lie in the fabric. This is because along the conical portion 35 of the mandrel, the circumferential speed of the surface progressively decreases toward the narrower end of the conical portion. As a result, the portions 37*a* of the weft yarns carried by the warp yarns 39 will progress toward the mandrel at successively lower speeds, as compared to the speeds at which portions 37*b* are being carried by warp yarns 38, the further toward the end of the mandrel the warp yarns 39 are positioned. The slowest warp yarn, i.e. the outermost warp yarn at the edge of the fabric, will, of course, move at the lowest speed, thus causing the greatest retardation of the weft yarn.

As a result, when the fabric has moved around the mandrel 31 to the position where it moves over the nip roller 23, the weft yarns on the outer edges of the fabric are no longer perpendicular to the direction of the length of the fabric, but rather are at an angle to the perpendicular, which angle increases the further the fabric moves along the direction of the length of the fabric. The same condition will exist if a difficult to weave yarn such as a carbon yarn material is woven instead of the Kevlar.

This may be acceptable for a piece of fabric to be used for wrapping around a generally cylindrical shape with conical portions joining portions of the cylindrical shape. However, if the portion of the fabric shaped on the conical portion 35 of the mandrel were to be cut from the remainder of the fabric into a narrow strip, the weft yarns would lie at angles other than perpendicular to the warp yarns, and this would cause distortion of the fabric if it were used for being shaped into, for example, a conical or spherical shape. The warp yarns in any such piece of fabric would be substantially concentric to an axis of the cone or sphere, much like latitudinal lines on a globe. The weft yarns, on the other hand, would be distorted, and rather than lie along lines similar to longitudinal lines of a globe, would run along a shape somewhat similar to a spiral across the surface of the shaped fabric. This would be unacceptable for the purposes for which a spherically shaped piece of cloth is to be used, namely shims for rocket parts, or forms for use as a parabolic antenna or a radar dome since yarn orientation is required.

Figure 5:
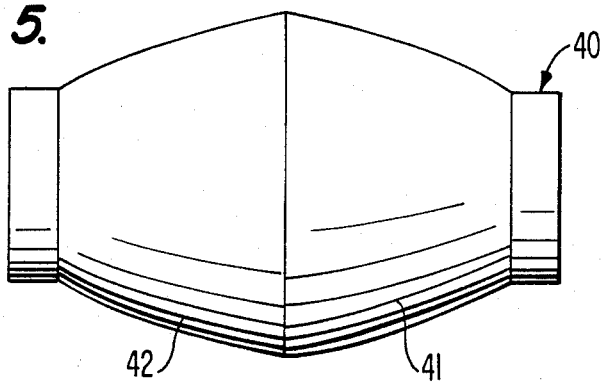
FIG. 5 is an elevation view of a mandrel according to the present invention for producing spherically contoured fabric.

The first modification to the apparatus of FIGS. 2a–2b for producing the spherically shaped fabric according to the present invention comprises providing a mandrel with sperhical surface portions thereon. As shown in FIG. 5, a preferred mandrel 40 has two spherical portions 41 and 42 the same shape as the section of the sphere shown in FIG. 1a, the spherical portions constituting the peripheral surfaces of the mandrel, with the larger diameter ends of the spherical portions abutting each other and the smaller diameter ends at the outer ends of the mandrel.

However, merely providing such a mandrel and a guide member which is contoured to guide the fabric into close contact with this thus shaped mandrel will not result in the desired fabric with the weft yarns in the proper positions along the longitudinal lines of the basic sphere. Shown in FIG. 6 is the mandrel 40 and a guide member 44 in the form of a cylindrical bar bent in the shape of the contour of the mandrel for guiding the fabric against the mandrel 40.

Figure 6:
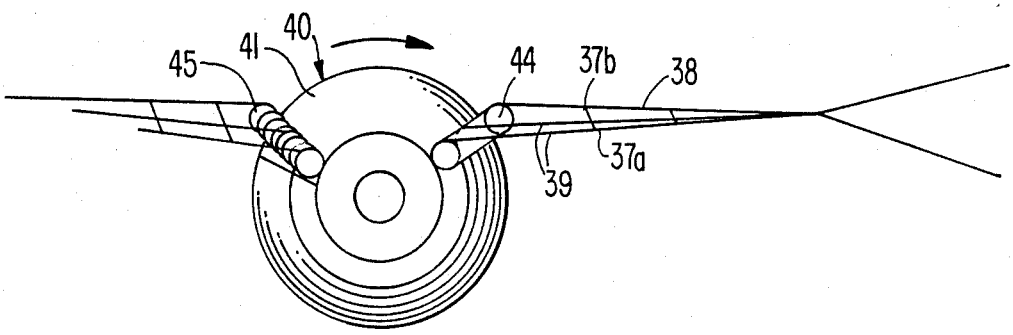
FIG. 6 is an end view of the mandrel of FIG. 5 as it would be placed in a conventional rapier-type loom without the improvement of the present invention.

However, as will be apparent from FIG. 6, the mere provision of such a guide bar 44 will not overcome the above-described problems of weft yarn distortion due to the varying speed and distance of the different warp yarns moving from the shed to the mandrel. As is clear from FIG. 6, the warp yarns moving to the largest diameter portion of the mandrel at the center of the length of the mandrel will move only a distance $L_1$, and since the radius $r_{mo}$ of the mandrel at this point is large, the velocity of the warp yarns at this point will be a maximum, i.e. a velocity $v_1$.

The warp yarns at the edge of the fabric will move along a slightly downwardly inclined path to the smaller diameter end of the mandrel where the radius is only $r_{mi}$. Because the peripheral velocity of the mandrel at this point will be much smaller than at the radius $r_{mo}$, the speed $v_2$ of the warp yarns on the downwardly inclined path will be somewhat less than the speed $v_1$ of the warp yarns moving through the distance $L_1$, and the net result will be that because of the longer path and the slower velocity, the portions 37a of the weft yarns at the edge of the fabric will be lagging behind the portion 37b at the center of the fabric, as shown schematically in the figure. The warp yarns moving toward the intermediate diameter portions $r_m$ will travel along an intermediate length path and at an intermediate velocity and will lag an intermediate amount.

The resulting weft yarns in the fabric wound on the mandrel for shaping will thus not lie perpendicular to the warp yarns, but will be at an angle thereto, and this distortion will continue into the finished fabric which is removed over a nip means 45 downstream of the guidebar 44.

The present invention provides the means for overcoming this problem, and this means consists of a warp yarn path length extending means generally indicated at 50 in FIGS. 7a and 7b. This means 50 in the preferred embodiment is a series of profiled members in the form of curved barrs 51–54. The bars are curved to have a profile similar to that of the profile of the mandrel 40, and the first bar is positioned so that the profile projects in one direction transversely to the path of the fabric, in this embodiment upwardly of the path of the fabric, and the next curved bar 52 having a similar profile projecting in the opposite direction transversely to the path of the fabric, i.e. downwardly from the path of the fabric. The third curved bar projects in the one direction, i.e. upwardly, and the fouth curved bar projects in the other direction, i.e. downwardly. The fabric moving from the shed to the mandrel is diverted back and forth across the normal path of the fabric over each of the bars until it reaches the guidebar 44.

The maximum point of projection of the contour of the bar is at the position corresponding to the center of the longitudinal length of the mandrel 40, and the lowest point on the profile of the bars corresponds to the position of the ends of the mandrel and lies along the path of the fabric.

It will be seen that the warp yarn or yarns which lie along the center of the fabric will be diverted by the first bar 51 out of the normal direct path from the position of the shed to the guide bar 44 a maximum distance $d_{max}$ above the path, and then diverted by the second bar 52 out of the normal direct path a distance $d_{max}$ below the normal path of the fabric. These central warp yarns are then directed by $d_{max}$ above and below the normal path again.

The warp yarns at the opposite edges of the fabric, on the other hand, will simply be guided along the ends of the bars in the normal path of the fabric.

The profiles of the bars and the number of bars is determined so that the combination of the normal shorter path length $L_1$ for the mid-fabric warp yarns and their incresed velocity $v_1$ will be completely compensated for, so that the portions of the weft yarns carried by these warp yarns will reach the mandrel 40 at the same time as the end portions of the weft yarns held by the warp yarns at the side edges of the fabric. As shown in FIG. 7b, this will mean that by the time the weft yarns have reached the guide bar 44, they will not only not have the ends lagging the center, but in fact the ends will have moved foward of the center and the curvature of the weft yarns will correspond to the profile of the mandrel 40. Thus, when the fabric is guided over the guide 44 onto the mandrel 40, the weft yarns will lie along lines corresponding to longitudinal lines on the spherical shape of the mandrel portions 41 and 42. As a result, the finished fabric when it is taken off over the nip roller 45 will have a spherical shape, yet the warp yarns and the weft yarns will be in the proper longitudinal and latitudinal relationship in relation to the spherical shape of the fabric. In view of the configuration of mandrel portions 41 and 42, in essence two liked spheroidal portions are produced. Accordingly, cutting means 46 is positioned adjacent to the longitudinal center of mandrel 40 for dividing the fabric coming off said mandrel 40 into individual spheroidal portions.

In addition to providing the warp yarn path length extending means 50, the modified loom of the present invention has a special nip roller means for nipping the fabric against the spherical mandrel in the form of a plurality of nip pressure rollers 60 at a position generally corresponding to the position of the nip roller 23 of the loom of FIGS. 2a and 2b. These rollers are positioned along the contour of the mandrel in side-by-side positions and press against the mandrel with a pressure sufficient to cause the mandrel to draw the fabric around the mandrel similarly to the nip roller 23 of the conventional loom. The rollers 60 can be mounted on arms 61 extending upwardly from a support 62, and can, if desired, be spring-loaded against the mandrel.

It is also an aspect of the present invention to provide the spheroidally contoured fabric, specifically a spherically contoured fabric, with a construction which has the desirable property that the yarn density is more uniform throughout the fabric.

As pointed out above, if the warp yarns supplied to the loom for making the spherically shaped fabric are uniformly spaced across the width of the fabric, these warp yarns in the finished fabric will be in the positions corresponding to latitudinal lines on a sphere, and will be at equal distances from each other across the surface of the sphere. The weft yarns, on the other hand, will correspond to longitudinal lines on the sphere and will converge toward the poles of the sphere. As a result, the density of the fabric, i.e. the number of yarns per unit area, will increase toward the poles.

To change this property, the present invention provides means in the form of the heddles 15 and associated warp yarn guiding means for causing the warp yarns toward the center of the width of the fabric, i.e. toward the larger diameter part of the finished spherically contoured fabric, to be closer together than at the edges of the fabric. As a result, as shown in FIG. 8, the fibers 70 lying along the latitudinal lines will be closer together toward the larger diameter part, and become progressively further apart the closer to the small diameter part they lie. By properly spacing the warp fibers in the loom, the number of fibers 70 and 71 per unit area of the fabric can be made substantially uniform.

Although the invention has been described by way of example with respect to only a single embodiment, it will be understood that various changes and modifications may be made without departing from the scope and spirit of the invention, and it is intended that such changes and modifications be included within the scope of the appended claims.

What is claimed is:

1. A loom for weaving contoured cloth, comprising:

shed forming means for receiving warp yarns from a warp yarn supply and forming a warp yarn shed;

means for inserting successive lengths of weft yarn through successive sheds formed by said shed forming means;

means for beating up the weft yarns into a woven fabric;

a contoured rotatably driven mandrel positioned downstream, relative to the direction of the warp yarn movement, from said beating up means for receiving the woven fabric and drawing it from said beating up means, said mandrel having at least a part thereof with a spheroidal shape for giving a spheroidal shape to the fabric passed around the mandrel;

a nip roller means engaged with the contoured surface of said mandrel for pressing the woven fabric against said mandrel for causing said mandrel to draw the woven fabric from said beating up means and shape the fabric according to the contour of said mandrel;

a fabric guide means adjacent said mandrel at a position along the path of the fabric from said beating up means to the point on said mandrel where said nip roller means is positioned, said fabric guide means having a contour along said mandrel corresponding to the contour of said mandrel and guiding the fabric into engagement with said mandrel; and warp yarn path length extending means positioned along the path of the fabric from said beating up means to said fabric guide means and having a contour transversely of the path of the fabric for increasing the lengths of the paths of the warp yarns of the fabric which are directed onto the portions of the spheroidally contoured part of said mandrel which are larger than the smallest diameter portion of the spheroidally contoured part, the increase being sufficient for making the lengths of such paths sufficiently longer than the length of the path of the warp yarn which is directed onto said smallest diameter portion of the spheroidally contoured portion of said mandrel to cause substantially all the length of each of the respective weft yarns to reach said mandrel at the same time.

2. A loom as claimed in claim 1 in which said means for inserting successive lengths of weft yarn is a rapier means.

3. A loom as claimed in claim 1 in which said contoured mandrel has two spheroidal portions extending outwardly from the longitudinal center of the mandrel, and further comprising means adjacent the longitudinal center of said mandrel for cutting the fabric coming off sid mandrel to divide the portion shaped on one spheroidal portion from the portion shaped on the other spheroidal portion.

4. A loom as claimed in claim 3 in which said two mandrel portions are spherical portions.

5. A loom as claimed in claim 1 in which said nip roller means comprises a plurality of individual spring-loaded nip rollers side by side along the surface of said mandrel.

6. A loom as claimed in claim 1 in which said fabric guide means comprises a bar extending along the mandrel and having a contour corresponding to the contour of said mandrel.

7. A loom as claimed in claim 1 in which said warp yarn path length extending means comprises a plurality of profiled members extending transversely to the path of the fabric, said members having a convexly curved profile and alternate members having the profile projecting above the path of the fabric and the remaining members having the profile projecting below the path of the fabric.

8. A loom as claimed in claim 7 in which said members are curved bars.

9. A loom as claimed in claim 1 further comprising means for spacing the warp yarns which are along the central portion of the path of the fabric through the loom closer together than the warp yarns near the edge of the path of the fabric, with the spacing between the warp yarns progressively increasing from the center of the path of the fabric toward the edges.

* * * * *